United States Patent [19]

Scott et al.

[11] Patent Number: 4,505,384

[45] Date of Patent: Mar. 19, 1985

[54] OVERWRAPPED WINDOW CARTON AND BLANK

[76] Inventors: Raymond G. Scott, 51 Bradford La., Oak Brook, Ill. 60521; Irvin W. Sherwood, 5431 Cumnor Rd., Downers Grove, Ill. 60515

[21] Appl. No.: 599,635

[22] Filed: Apr. 12, 1984

[51] Int. Cl.[3] ..... B65D 25/54

[52] U.S. Cl. ..... 206/45.33; 206/45.31; 229/37 R

[58] Field of Search ..... 206/45.14, 45.31, 45.33, 206/45.34; 229/87 R, 37

[56] References Cited

U.S. PATENT DOCUMENTS

| | | | |
|---|---|---|---|
| 2,886,234 | 5/1959 | Toensmeier | 206/45.31 |
| 3,388,787 | 6/1968 | Growney | 206/45.14 |
| 3,424,367 | 1/1969 | Desmond et al. | 229/38 |
| 3,528,598 | 9/1970 | Lock | 206/45.31 |
| 4,429,791 | 2/1984 | Ruppel et al. | 206/45.31 |

FOREIGN PATENT DOCUMENTS

| | | | |
|---|---|---|---|
| 2338870 | 8/1977 | France | 206/45.31 |

*Primary Examiner*—William T. Dixson, Jr.
*Assistant Examiner*—Brenda J. Ehrhardt
*Attorney, Agent, or Firm*—Evelyn M. Sommer

[57] ABSTRACT

An overwrapped carton is provided having a tubular body formed from a blank of paperboard cut and scored to provide a plurality of serially connected walls, one of which has a window or dispensing opening cut therein. A thin flexible protective sheet of film is disposed to extend over certain of the walls and the window and has end portions secured to one of the walls and a glue connector flap which secures the walls in a tubular array. The connector flap is formed from the material removed and cut from the wall to form the window, economizing on board material.

15 Claims, 13 Drawing Figures

Fig. 6.
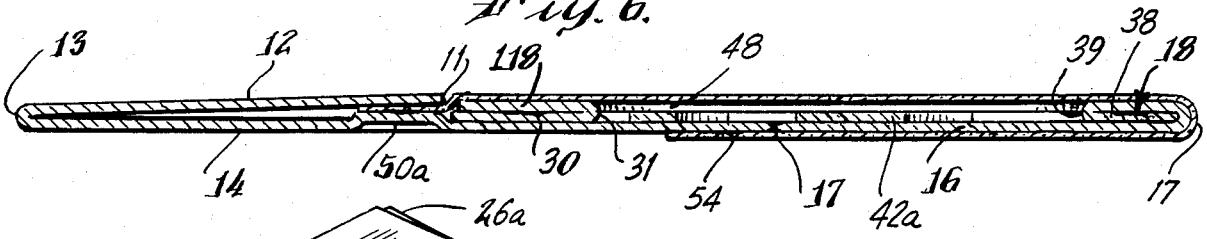
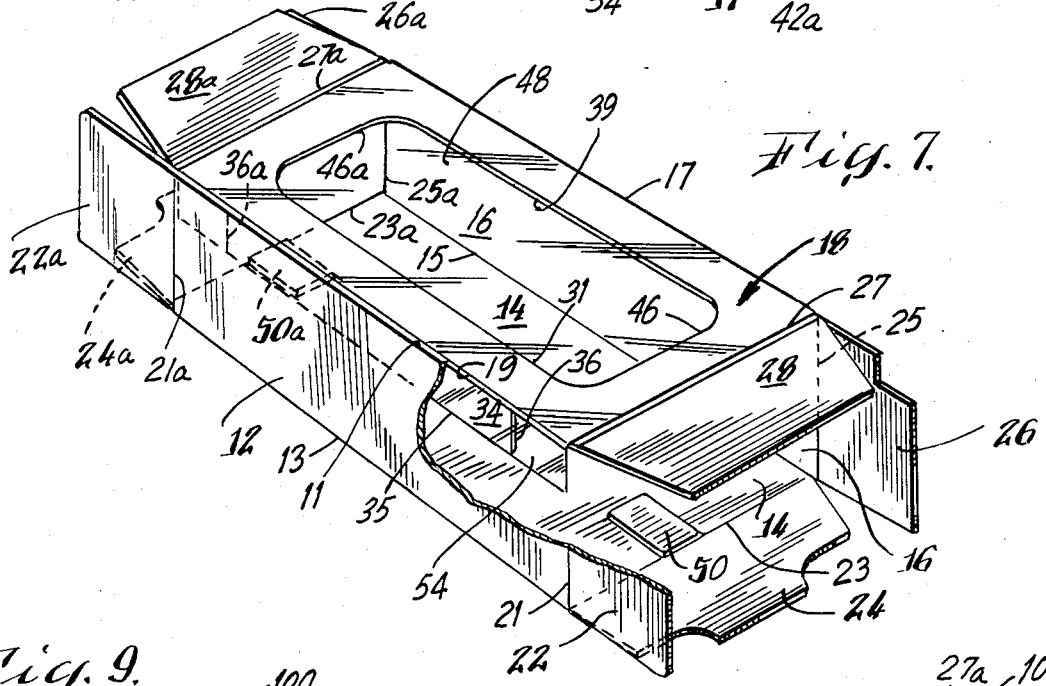
Fig. 7.
Fig. 9.
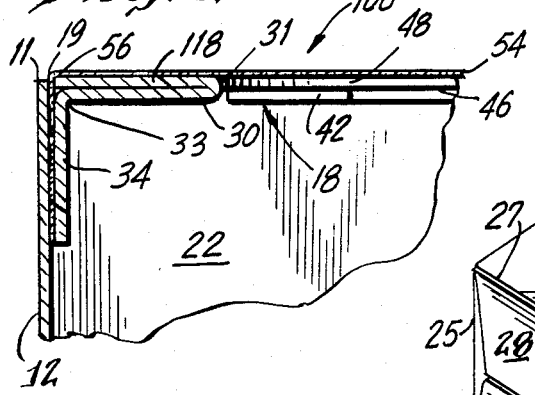
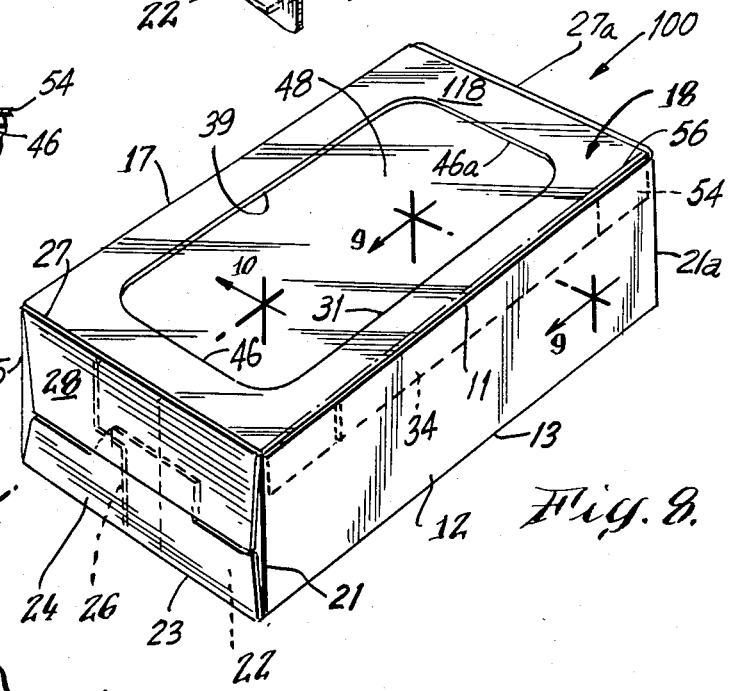
Fig. 8.
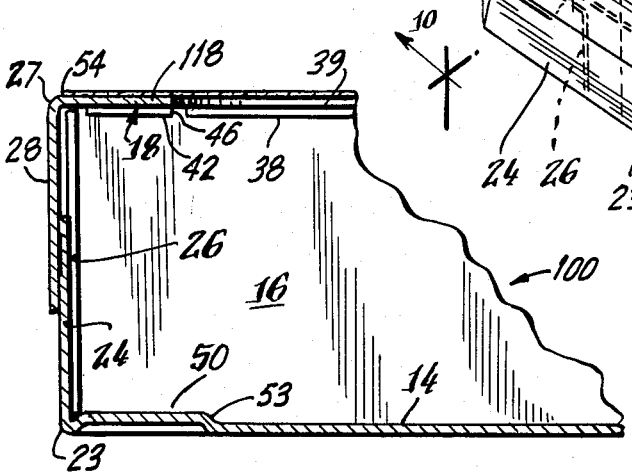
Fig. 10.

OVERWRAPPED WINDOW CARTON AND BLANK

BACKGROUND OF THE INVENTION

Paperboard cartons having a window through which a product may be dispensed are known. Several such cartons have a panel which can be removed by the consumer after purchasing the product to form the window and give access to the product therein. Other cartons have been developed where the window exists at the time of purchase. With this latter type of carton, the product stored therein is protected and preserved by a plastic overwrap which extends entirely across the window and the portions of the carton adjacent thereto. In cartons of this type the plastic overwrap may be provided with weakened areas to facilitate its removal. Thus, the paperboard wall panels of the carton will not be torn during the initial opening of the carton. Additionally, the portions of the carton which define the window can be made very smooth to avoid damage to the product as it is being dispensed from the carton. One such overwrapped window carton is shown in U.S. Pat. No. 3,424,367 which issued to Desmond et al. on Jan. 28, 1969.

Despite the many advantages of the existing overwrapped window cartons, it is considered desirable to provide improved cartons of this type which utilize less paperboard material and which enable a structurally secure carton.

Accordingly, it is an object of the subject invention to provide an overwrapped paperboard window carton and a blank therefor which utilizes significantly less paperboard material.

It is another object of the subject invention to provide an overwrapped paperboard window carton which can be securely glued into its erected condition.

It is an additional object of the subject invention to provide an overwrapped paperboard window carton and blank which efficiently utilizes the paperboard material in the area of the window.

It is a further object of the subject invention to provide a paperboard blank for an overwrapped window carton which ensures a smooth level gluing surface to facilitate erection of the carton.

SUMMARY OF THE INVENTION

The blank of the subject invention includes rectangular first side panel, bottom panel, second side panel and top panel which are consecutively articulated along parallel fold lines. End flaps are articulated respectively along opposed ends of the first side panel, bottom panel, second side panel and top panel. The top wall panel includes a plurality of fold and cut lines to define the window therein. Within the area defined by the window, the fold and cut lines further define a plurality of support flaps which can be rotated out of the area of the window and in to face to face contact with the top wall panel. The support flaps structurally support the top wall panel to prevent damage, and further ensure a substantially smooth perimeter to the window, thus minimizing any chance of damage to products being removed from the carton. A glue lap is foldably connected to the support flap most distant from the first and second side wall panels on the blank. The glue lap also can be rotated out of the area defined by the window so as to lie entirely outside the area of the top wall panel.

This glue lap thus can be adhesively connected to the free edge of the first side wall panel.

A plastic overwrap film is applied to the surfaces of the second side panel and top panel that will define the outer surface of the carton. More particularly, the plastic film extends from the bottom panel entirely across the second side and top panels and the glue lap formed from the top panel.

The bottom panel and/or the first side panel includes embossments disposed thereon to extend between the glue lap and the end flaps of the carton. The embossment provides a continuous surface to which pressure may be applied to ensure a secure adhesion of the first side panel of the blank to the plastic overwrap, thus providing a strong carton.

BRIEF DESCRIPTION OF THE DRAWINGS

FIGS. 5 and 7 are perspective views illustrating further steps in folding the blank of FIG. 1 to form the erected carton of the present invention.

FIG. 6 is a cross-sectional view taken along line 6—6 in FIG. 5.

FIG. 8 is a perspective view of the fully erected carton of the present invention.

FIG. 9 is cross-sectional view taken along line 9—9 in FIG. 8.

FIG. 10 is a cross-sectional view taken along line 10—10 in FIG. 8.

DETAILED DESCRIPTION OF THE PREFERRED EMBODIMENTS

Figure 1:
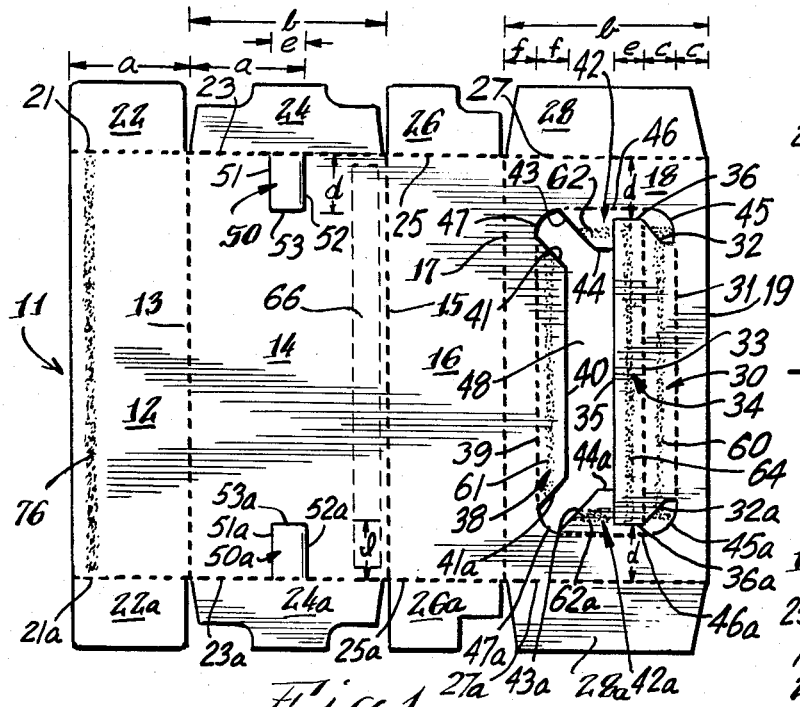
FIG. 1 is a plan view of the blank of the present invention.

The blank of the subject invention is indicated generally by the numeral 10 in FIG. 1. More particularly, the blank 10 is formed from a single sheet of paperboard material. FIG. 1 shows the surface of blank 10 which will define the inside of the carton to be formed therefrom.

The blank 10, as illustrated in FIG. 1, includes generally rectangular first side panel 12, bottom panel 14, second side panel 16 and top panel 18 which are articulated to one another along parallel fold lines 13, 15 and 17.

End flaps 22 and **22*a* are articulated to the first side panel 12 along fold lines 21 and 21*a* respectively. More particularly, fold lines 21 and 21*a* are parallel to one another and extend at right angles from opposed ends of fold line 13. The side panel 12 is further defined by edge 11 which is parallel to fold line 13 and extends between the fold lines 21 and 21*a***.

Substantially identical end flaps 24 and 24a are articulated to the bottom panel 14 along parallel fold lines 23 and 23a respectively. The bottom panel 14 is further defined by embossed areas 50 and 50a which extend upwardly out of the surface of blank 10 shown in FIG. 1, an amount approximately equal to the thickness of the paperboard material from which blank 10 is formed. More particularly, the embossed areas 50 and 50a are substantially rectangular in configuration, and are defined by opposed embossed edges 51, 52, 51a and 52a respectively, which are aligned substantially perpendicular to the fold lines 23 and 23a respectively as illustrated in FIG. 1. The embossments 50 and 50a are further defined by fold lines 23 and 23a respectively and by embossed edges 53 and 53a which are parallel to the fold lines 23 and 23a and extend between the embossed edges 51, 52, 51a and 52a respectively. As illustrated in FIG. 1, the embossed edges 52 and 52a of embossments 50 and 50a define the portions of the respective embossments 50 and 50a most distant from fold line 13. The distance between fold line 13 and the embossed edges 52 and 52a, as indicated by dimension "a" in FIG. 1 is substantially equal to the distance between edge 11 and fold line 13 on the first side panel 12. Additionally, the distance between the fold line 17 and the embossed edges 52 and 52a, as indicated by dimension "b", is equal to the width of the top and bottom panels 14 and 16 as shown in FIG. 1. The bottom panel 14 is further defined by an adhesive area 66 which is disposed adjacent fold line 15 on the surface of blank 10 opposite the surface shown in FIG. 1. Adhesive area 66 is used to attach the plastic overwrap as explained below.

Substantially identical end flaps 26 and 26a are articulated to the second side panel 16 along fold lines 25 and 25a respectively. The fold lines 25 and 25a are substantially equal in length to the fold lines 21 and 21a.

Substantially identical end flaps 28 and 28a are articulated to the top wall panel 18 along fold lines 27 and 27a respectively. Fold lines 27 and 27a are substantially equal in length to the fold lines 23 and 23a respectively. Additionally, the fold lines 21, 23, 25 and 27 are substantially collinear, while the fold lines 21a, 23a, 25a and 27a also are substantially collinear.

Top panel 18 is further defined by edge 19 which is parallel to the fold line 17 and which extends between fold lines 27 and 27a. The top wall panel 18 includes a plurality of cut lines and fold lines as described herein, which enable the formation of a strong smooth-edged window in the carton formed from blank 10, and which further provide an efficiently formed glue lap. More particularly support flap 30 is formed in the top wall panel 18 by fold lines 31 and 33 which extend parallel to edge 19, and by cut lines 32 and 32a which extend respectively between the opposed ends of the fold lines 31 and 33. As indicated by dimensions "c" in FIG. 1, the distance between edge 19 and fold line 31 is substantially equal to the distance between fold lines 31 and 33. Glue lap 34 is articulated to support flap 30 along fold line 33. Glue flap 34 is further defined by cut lines 35, 36 and 36a. Cut lines 36 and 36a are substantially parallel to the fold lines 27 and 27a, and are spaced therefrom a distance "d" which is substantially equal to the distance "d" between embossed edge 53 and fold line 23 on embossment 50, and the distance "d" between embossed edge 53a and fold line 23a on embossment 50a. Additionally, the distance "e" between cut line 35 and fold line 33 is substantially equal to the distance "e" between embossed edges 51 and 52 on embossment 50 and between embossed edges 51a and 52a on embossment 50a. Preferably fold line 33 is longer than fold line 31 to increase the length of the glue lap 34 for the reasons explained below.

Support flap 38 also is formed in the top panel 18, and is defined by fold line 39 which is parallel to fold line 17 and by cut lines 40, 41 and 41a. Cut line 40 extends parallel to the fold line 39 and is spaced therefrom a distance "f" substantially equal to the distance "f" between fold lines 39 and 17. Cut lines 41 and 41a extend between the opposed ends of fold line 39 and cut line 40.

Support flaps 42 and 42a also are formed in the top panel 18. Specifically, support flap 42 is defined by cut lines 32, 35, 36, 43, 44 and 45 and by fold line 46. Similarly the support flap 42a is defined by cut lines 32a, 35a, 36a, 43a, 44a and 45a and by fold line 46a. The fold lines 46 and 46a are parallel to the fold lines 27 and 27a. Additionally, the cut lines 44 and 44a are parallel to fold lines 46 and 46a respectively, and are spaced therefrom a distance substantially equal to the distance between fold lines 46 and 27 on the one hand and fold lines 46a and 27a on the other hand. The cut lines 45 and 45a are arcuate and extend between the opposed ends of fold line 31 and the ends of fold lines 46 and 46a respectively.

The top panel 18 is further defined by arcuate cut lines 47 and 47a which extend respectively between opposed ends of fold line 39 and the fold lines 46 and 46a. Thus, the cut lines 35, 40, 41, 41a, 43, 43a, 44, 44a, 47 and 47a define window 48 in the top wall panel 18. Additionally, the support flaps 30, 38, 42 and 42a are provided with adhesive areas 60, 61, 62 and 62a respectively on the surfaces thereof shown in FIG. 1. Similarly, the glue lap 34 is provided with an adhesive area 64 on the surface shown in FIG. 1.

Figure 2:
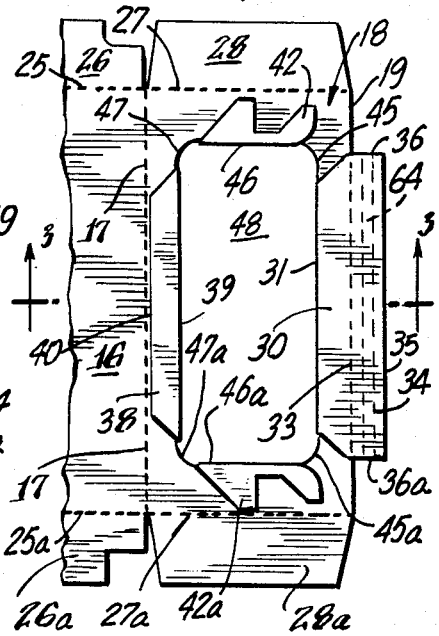
FIG. 2 is a partial plan view of the right hand portion of the blank illustrated in FIG. 1 folded to illustrate a step in the formation of the carton of the present invention.
Figure 3:
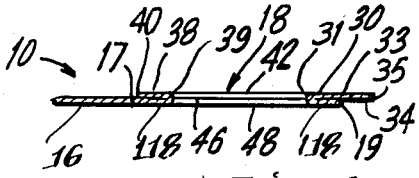
FIG. 3 is a cross-sectional view taken along line 3—3 in FIG. 2.
Figure 5:
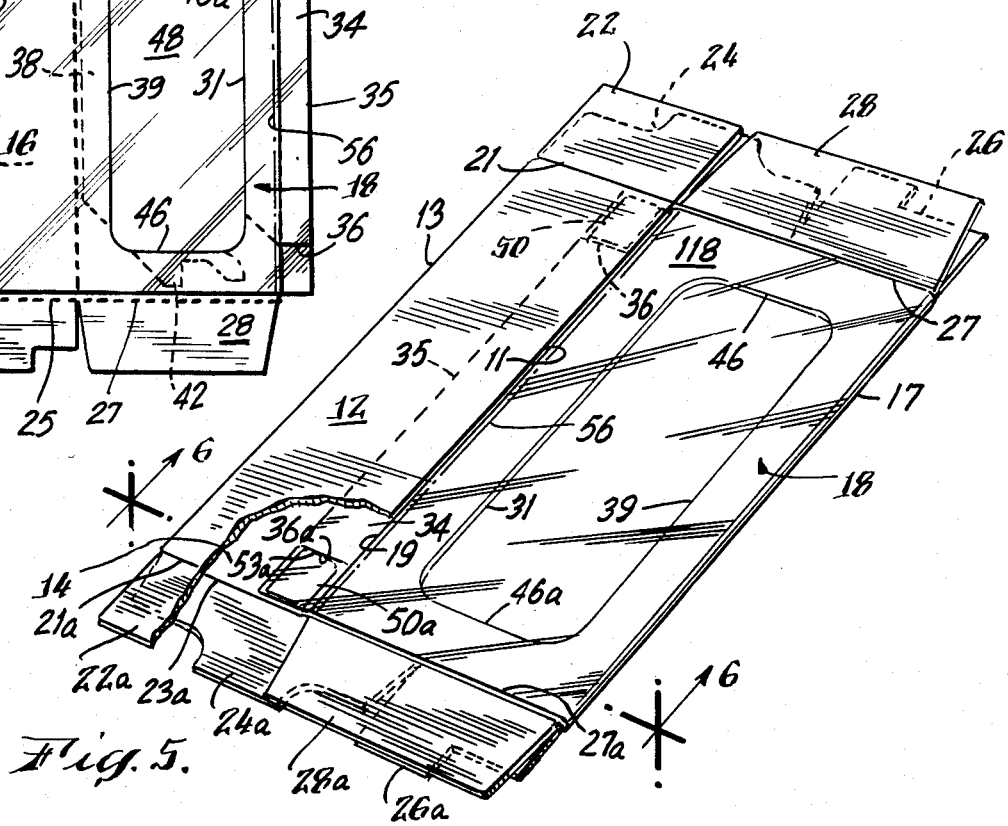

The blank 10 is erected into a carton by folding the support flaps 30, 38, 42 and 42a about their fold lines 31, 39, 46 and 46a respectively, as illustrated most clearly in FIGS. 2 and 3. Support flaps 30, 38, 42 and 42a are affixed in face-to-face contact to the remainder of top panel 18 by adhesive areas 60, 61, 62 and 62a. Thus, fold line 33 is substantially adjacent to the edge 19 of the top panel 18. Additionally, the glue lap 36 lies outside the area defined by the top panel 18. Similarly, when support flap 38 is rotated about fold line 39 the edge 40 thereof will be substantially adjacent to fold line 17. When support flaps 42 and 42a are rotated about fold lines 46 and 46a the edges 44 and 44a thereof will lie substantially adjacent to fold lines 27 and 27a. By folding the support flaps 30, 38, 42 and 42a as explained above, the window 48 in the top wall panel 18 assumes a generally rectangular configuration. The portion of the top panel 18 against which the support flaps 30, 38, 42 and 42a lie will define the outer top panel 118 on the carton erected from blank 10 as explained herein. The fold lines 31, 39, 46 and 46a define the respective edges of the generally rectangular window 48, while cut lines 45, 45a, 47 and 47a define generally arcuate corners for opening 48. As a result of this configuration, as illustrated best in FIG. 2, the opening 48 has double thickness edges substantially around its perimeter. Furthermore, the fold lines 31, 39, 46 and 46a are smooth and substantially prevent damage to material such as thin paper tissues that may be packed in the carton erected from blank 10. The support flaps 30, 38, 42 and 42a further provide support for the top panel 18 to prevent damage as articles are removed from the carton formed from blank 10.

Figure 4:
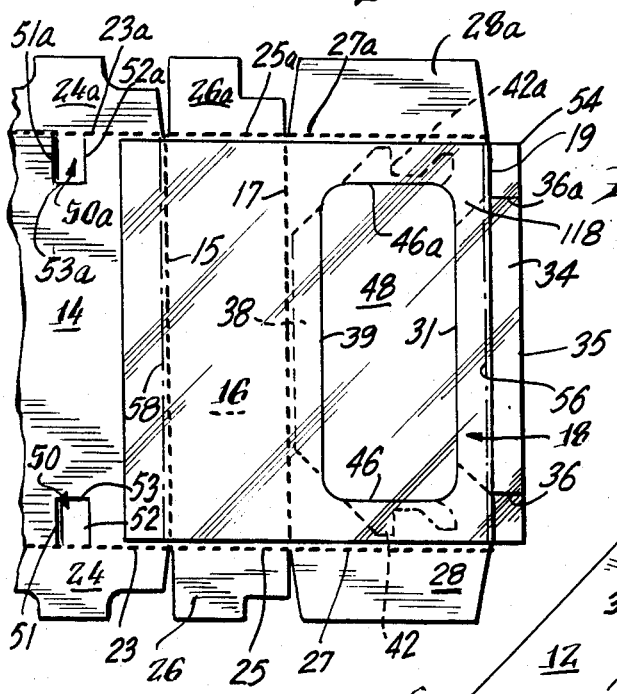
FIG. 4 is a view similar to FIG. 1, but illustrating the adhesion of a flexible overwrap sheet to the carton blank.

Blank 10 is further formed into a carton by applying a plastic film 54 to the surface of blank 10 opposite the surface shown in FIGS. 1 and 2. More particularly, as illustrated most clearly in FIG. 4, the plastic film 54 is substantially rectangular and covers the glue flap 34, the top panel 18, the second side panel 16 and a portion of bottom panel 14. Additionally, the plastic film 54 extends substantially the entire distance between the fold lines 27 and 27*a* on top panel 18. Thus, as shown in FIG. 4, the plastic film 54 extends beyond the opposed ends 36 and 36*a* of glue lap 34. Preferably, the plastic film 54 is adhered to the blank 10 at the adhesive area 64 on the glue lap 34 and by an adhesive area 66 on the bottom wall panel 14.

The blank 10 is further erected into a carton by rotating top panel 18 about fold line 17 such that the top panel 18 lies in face to face relationship with second side panel 16 and a portion of the bottom panel 14. Next, the first side panel 12 is rotated about the fold line 13 to lie in face to face relationship with the bottom panel 14.

The plastic film 54 is provided with elongated generally parallel weakened areas 56 and 58. More particularly, the elongated weakened area 58 is disposed substantially adjacent to the fold line 15, while the elongated weakened area 56 is disposed substantially adjacent to the edge 19. The weakened areas 56 and 58 may be defined by a plurality of perforations which facilitate the removal of the plastic film on the erected carton.

As result of the dimensions described above, the portions of edge 19 of top panel 18 which are disposed on either side of the glue lap 34 will be disposed substantially adjacent the embossed edges 52 and 52*a* of embossments 50 and 50*a*. Additionally, the glue lap 34 will extend substantially the entire distance between the embossments 50 and 50*a*. Furthermore, edge 11 of side wall panel 12 will lie substantially adjacent to the embossed edges 51 and 51*a* of embossments 50 and 50*a* respectively. The first side panel 12 then is adhered to the plastic film 54 at the locations where the plastic film 54 overlays the glue lap 34 and the embossments 50 and 50*a*. Preferably, an adhesive 76 is applied to the first side panel 12 enabling the first side panel 12 to be adhered to the plastic film 54. The adhesion of the first side panel 12 to plastic film 54 effectively secures the first side panel 12 to glue lap 34, and effectively articulates the first side panel 12 to the top panel 18. To achieve the desired strength of this articulated connection between the first side panel 12 and top panel 18, it is preferred that the glue lap 34 extend at least 70% of the distance between the opposed fold lines 21 and 21*a* on first side panel 12.

The embossments 50 and 50*a*, as noted above, extend out of the plane of the blank 10 an amount substantially equal to the thickness of the paperboard material from which the blank 10 is formed. As a result, there is a substantially continuous surface extending across the embossments 50 and 50*a* and the glue lap 34 to ensure a good adhesive attachment merely by the application of pressure to the first side panel 12 on the side thereof opposite the adhesive 76. This secure adhesive attachment would be noticeably more difficult to obtain in the area adjacent fold lines 21 and 21*a* if the embossed areas 50 and 50*a* were not present.

The blank 10 is further formed into the erected carton by urging fold lines 13 and 17 toward one another to form a tubular structure shown in FIG. 7. The tubular structure is closed into an erected carton by rotating the end flaps 22, 24, 26 and 28 about fold lines 21, 23, 25 and 27 respectively. Similarly, after the articles have been placed in the partly erected carton, end flaps 22*a*, 24*a*, 26*a* and 28*a* may be rotated about fold lines 21*a*, 23*a*, 25*a*, and 27*a* respectively. The erected carton, as indicated generally by the numeral 100 in FIG. 8 has a plastic film 54 extending entirely over the opening 48. The plastic film 54 can be easily removed by pulling on one end to cause a severance along the lines of weakness 56 and 58 which extend generally along the fold line 15 and the edge 19. As illustrated most clearly in FIGS. 9 and 10, the intersection of the top panel 18 and first side panel 12 forms a secure and structurally strong joint with a minimum usage of paperboard material. More specifically, the glue lap 34 which joins the top panel 18 and the first side panel 12 is formed from the material which originally had been within the boundaries defined by the generally rectangular top panel 18. However, the provision of this efficiently formed glue lap 34 does not affect the structural integrity of the various glued connection as illustrated most clearly in FIGS. 9 and 10.

Figure 11:
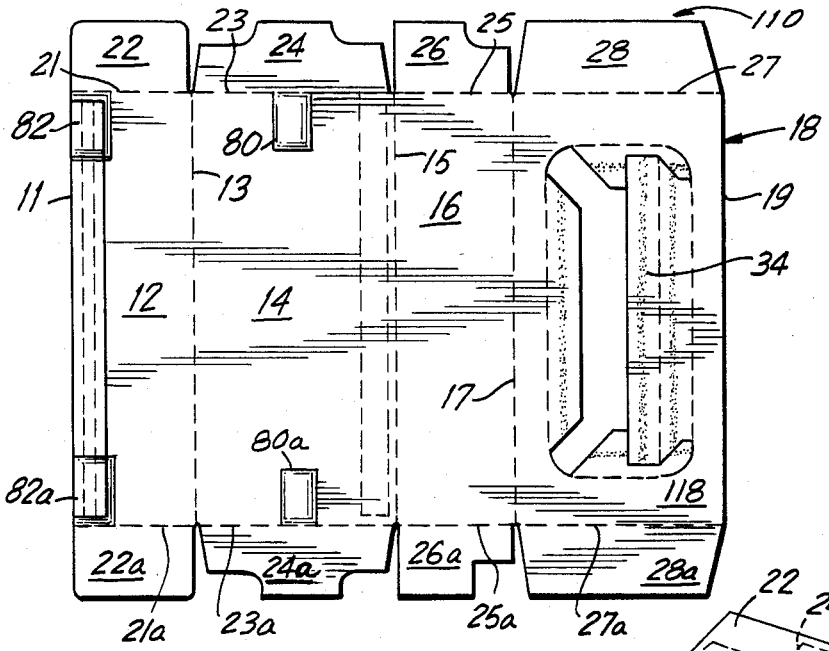
FIG. 11 is a plan view of an alternate blank of the subject invention.
Figure 12:
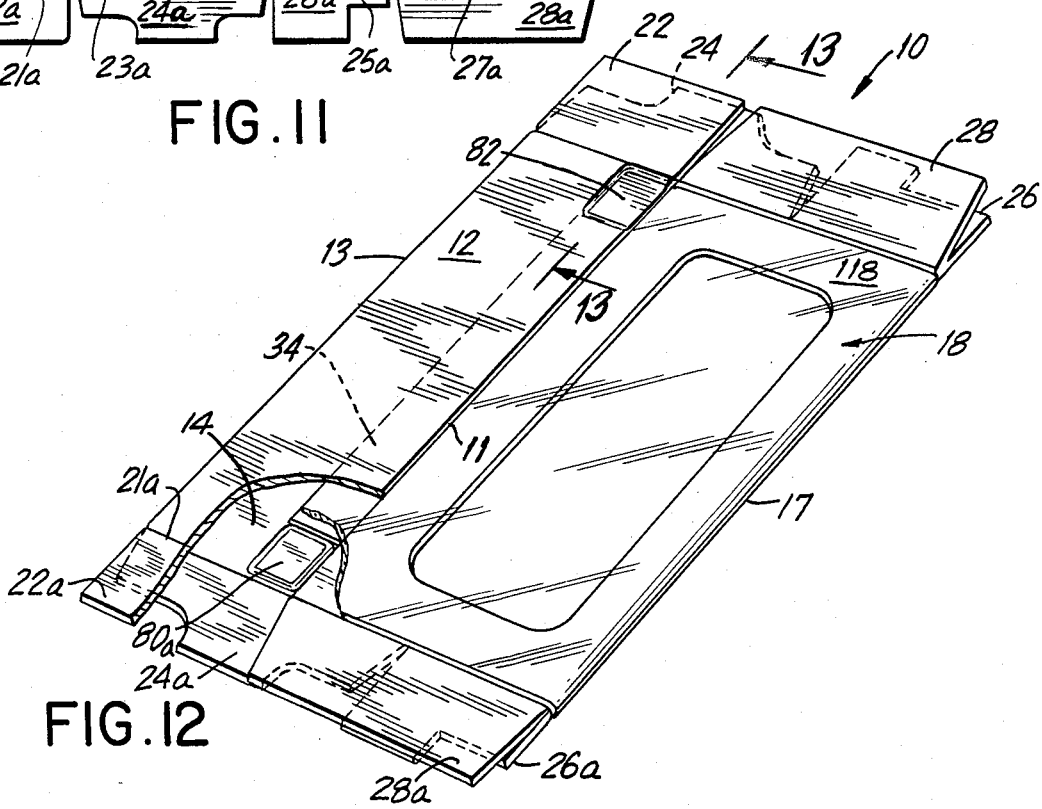
FIG. 12 is a perspective view, partly in section, of the blank illustrated in FIG. 11 folded to illustrate a step in the formation of the carton of the subject invention.
Figure 13:
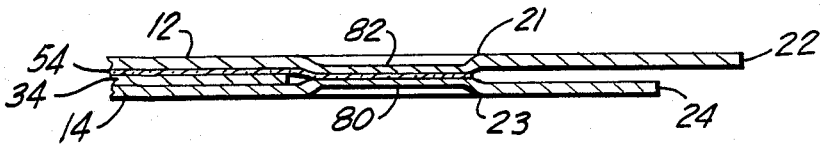
FIG. 13 is a cross-sectional view taken along line 13—13 in FIG. 12.

Turning to FIGS. 11 through 13, an alternate blank is indicated generally by the numeral 110. Blank 110 is substantially similar to the blank 10 illustrated and described above, and like numbers have been applied to similar structural members throughout. However, the embossments 80 and 80*a* on bottom panel 14 extend out of the plane of blank 110 only about one-half the thickness of the paperboard material from which the blank 110 is formed. Additionally, side wall panel 12 of the blank 110 is provided with embossments 82 and 82*a*. More particularly, the embossments 82 and 82*a* extend upwardly from the surface of blank 110 shown in FIG. 11, an amount substantially equal to one-half the thickness of the paperboard material. The embossments 82 and 82*a* are substantially the same size as the embossments 80 and 80*a* and are disposed substantially adjacent to the corners formed by edge 11 and fold lines 21 and 21*a*. Consequently, as illustrated most clearly in FIG. 12, when bottom panel 12 is rotated about fold line 13 the embossments 82 and 82*a* will lie substantially in face to face contact with the embossments 80 and 80*a* respectively. Since the respective depths of the embossments 80, 80*a*, 82 and 82*a* are substantially equal to one-half the thickness of the paperboard material from which blank 110 is formed, there will be defined a substantially level and smooth area to apply pressure against for adhering edge 11 substantially adjacent to glue lap 34 and plastic film 54. This smooth area ensures a secure adhesive connection between the glue lap 34 and the plastic film 54.

In summary an improved overwrap window carton and a blank for said carton are provided. The blank for forming the subject carton includes consecutively articulated first side panel, bottom panel, second side panel and top panel. End flaps are articulated to the opposed ends of said first side, bottom, second side and top panels. The top panel is further defined by an edge extending generally parallel to the foldable connection between the second side panel and top panel. The top panel also is characterized by a plurality of cut and fold lines which form support flaps which can be folded out of the plane of the top panel to form a generally rectangular opening in the top panel. A glue lap also is defined in said top wall panel and is articulated to one said support flap. The glue lap and the support flap foldably connected thereto can be rotated out of the plane of the top panel such that their foldable connection will lie generally along the edge of the top panel opposite the second side panel. This glue lap subsequently can be secured to the first side panel to enable the erection of said blank into a carton. A flexible sheet of plastic film is adhered to the glue lap and to the bottom panel. The plastic film is provided with weakened areas to enable easy removal from the carton. The bottom panel includes embossments which enable a continuous surface for adhering the first side wall panel to the glue lap and plastic film. In an alternate embodiment compatible embosssments are provided respectively on the bottom panel and first side panels. As a result of this construction the subject carton makes efficient use of paperboard material and ensures a secure structure.

While the subject invention has been described and illustrated with respect to certain preferred embodiments, it is obvious that various changes and modifications can be made therein without departing from the spirit of the present invention which should be limited only by the scope of the appended claims.

What is claimed is:

1. A generally rectangular overwrapped paperboard window-carton comprising:

top and bottom walls disposed in spaced parallel relationship, said top wall comprising an outer top panel having a window extending therethrough to provide access to the inside of the carton, said top wall further including at least one support flap, said support flap being disposed in face-to-face contacting relationship with said outer top panel and being foldably connected to said outer top panel adjacent the opening therein;

first and second opposed side walls foldably connected to and extending between said top and bottom walls, said first side wall comprising an outer side wall panel and a glue lap adhered in face to face contacting relationship with said outer side wall, said glue lap being adjacent said top wall and foldably connected to the support flap of said top wall;

first and second opposed end walls foldably connected to and extending between said top, bottom and first and second side walls; and a plastic overwrap removably connected to said carton and covering the window in said outer top panel of said top wall.

2. A carton as in claim 1 wherein said plastic overwrap extends substantially over the entire top wall and second side wall, said plastic overwrap being adhered to the bottom wall of the carton and to the first side wall of the carton intermediate the outer panel thereof and the glue lap.

3. A carton as in claim 2 wherein said glue lap includes opposed ends which are spaced from said end walls of said carton.

4. A carton as in claim 2 wherein said first side wall includes inwardly directed embossments disposed adjacent the top wall and extending respectively between the opposed ends of the glue lap and the opposed end walls of the carton.

5. A carton as in claim 4 wherein said bottom wall includes inwardly directed embossments of substantially the same size and configuration as the embossments in said first side wall, the embossments in said first side wall and bottom wall being substantially equally spaced from the foldable connection between said first side wall and bottom wall, whereby said embossments facilitate the adhesive connection of said first side wall and top wall during the erection of the carton.

6. A carton as in claim 1 wherein the window in said outer top panel is generally rectangular with opposed first and second side edges and first and second end edges extending generally parallel the opposed first and second side walls and end walls respectively of the carton.

7. A carton as in claim 6 wherein the top wall includes a plurality of said support flaps foldably connected to said outer top panel at the respective side and end edges of said window, said support flaps being adhered in face to face contacting relationship with the outer top panel and foldably connected to the outer top panel adjacent the opening therein.

8. A generally planar paperboard blank for forming a window-carton, said blank comprising rectangular first side panel, bottom panel, second side panel, and top panel consecutively articulated to one another along parallel fold lines, said first side panel and top panel being further defined by edges extending parallel to their respective foldable connections to said bottom panel and second side panel, said first side panel, bottom panel, second side panel and top panel each including opposed ends, end flaps articulated respectively to the opposed ends of said first side panel, bottom panel, second side panel and top panel, said top panel including a support flap formed in said top panel and articulated thereto along a support fold line which is parallel to and spaced from said edge of said top panel, said top panel further including a glue lap intermediate said second side panel and said support flap and articulated to said support flap along a fold line parallel to said support fold line and spaced therefrom a distance substantially equal to a distance between said support fold line and said edge of said top panel, whereby said support flap and said glue lap may be rotated about said support fold line to define a window in said top panel, and whereby said glue lap can be adhered to said first side panel adjacent the edge thereof to define a tubular carton.

9. A blank as in claim 8 wherein the bottom panel of said blank further includes a pair of substantially identical spaced apart embossments disposed respectively adjacent to the foldable connections of said bottom panel to said end flaps, said embossments each being defined by first and second embossed edges disposed parallel to the foldable connections of said bottom panel to said first and second side panels, with the respective first embossed edges of said embossments being closer to the first side panel than the second embossed edges thereof, the distance between said first side panel and said second embossed edges of said embossments being substantially equal to the distance between said bottom panel and said edge of said first side panel, and with the distance between said top panel and said second embossed edges of said embossments being substantially equal to the distance between said second side panel and the edge of said top panel.

10. A blank as in claim 9 wherein the length of said glue lap as measured parallel to the edge of said top panel is substantially equal to the spacing between said embossments on said bottom panel.

11. A blank as in claim 9 wherein said glue lap is rectangular and wherein the width of the rectangular glue lap as measured perpendicular to the foldable connection between said glue lap and said support flap substantially equals the distance between said first and second embossed edges of said embossments.

12. A blank as in claim 9 wherein said embossments extend out of the plane of said bottom panel a distance substantially equal to the thickness of the paperboard material from which said blank is formed.

13. A blank as in claim 9 wherein the pair of embossments on said bottom panel is a first pair of embossments, and wherein said blank further includes a second pair of spaced apart embossments disposed on said first side panel adjacent the edge thereof and adjacent the respective foldable connections between said first side panel and its end flaps, the embossments in said first and second pairs of embossments being substantially identical.

14. A blank as in claim 13 wherein said embossments extend upwardly from the surface of said blank which will define the inside of a carton formed therefrom, said embossments extending from said blank a distance substantially equal to one-half the thickness of the paperboard material from which said blank is formed.

15. A blank as in claim 8 further including a generally rectangular sheet of plastic material disposed in face-to-face contacting relationship with substantially the entire second side panel and top panel and at least a portion of said bottom panel.

* * * * *